US007850167B2

(12) United States Patent
Bluethgen et al.

(10) Patent No.: US 7,850,167 B2
(45) Date of Patent: Dec. 14, 2010

(54) DEVICE AND TRAY FOR DEPOSITING SHEETS

(75) Inventors: Soenke C. Bluethgen, Ploen (DE); Soenke Dehn, Daenischenhagen (DE); Frank Nagel, Kiel (DE); Dieter R. Gritzuhn, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/094,289

(22) PCT Filed: Jun. 27, 2006

(86) PCT No.: PCT/EP2006/006219

§ 371 (c)(1),
(2), (4) Date: May 20, 2008

(87) PCT Pub. No.: WO2007/059811

PCT Pub. Date: May 31, 2007

(65) Prior Publication Data

US 2008/0230983 A1 Sep. 25, 2008

(51) Int. Cl.
*B65H 31/00* (2006.01)

(52) U.S. Cl. ..... 271/207; 271/213

(58) Field of Classification Search ..... 271/207, 271/213, 214, 217

See application file for complete search history.

(56) References Cited

U.S. PATENT DOCUMENTS

| | | | | |
|---|---|---|---|---|
| 3,957,264 | A | 5/1976 | Bach et al. | |
| 4,265,444 | A | 5/1981 | Berglund | |
| 4,605,211 | A | 8/1986 | Sonobe | |
| 5,350,169 | A | 9/1994 | Hiroi et al. | |
| 5,374,051 | A | 12/1994 | Ulrich et al. | |
| 5,497,984 | A | 3/1996 | Murakami et al. | |
| 5,988,621 | A | 11/1999 | Kondo et al. | |
| 2002/0079642 | A1 * | 6/2002 | Tamura et al. | 271/207 |
| 2002/0113362 | A1 * | 8/2002 | Saito et al. | 271/207 |
| 2002/0135121 | A1 | 9/2002 | Boss | |

FOREIGN PATENT DOCUMENTS

| | | |
|---|---|---|
| DE | 3708157 | 5/1991 |
| DE | 10141812 | 6/2002 |
| GB | 2341598 | 3/2000 |
| JP | 58202248 | 11/1983 |
| JP | 62046862 | 2/1987 |
| JP | 2001-341927 | 11/2001 |

* cited by examiner

*Primary Examiner*—David H Bollinger

(57) ABSTRACT

The invention relates to a device for depositing sheets in a machine that preferably processes sheets by graphic means, in particular for a printing machine, preferably for an electro-photographically operating machine, comprising at least one deposit tray for depositing and preferably also for stacking processed sheets. Furthermore, the invention relates to a deposit tray for a device of the aforementioned type. The object of the invention is to provide a device or a deposit tray of the aforementioned type, which permits a controlled depositing and stacking of sheets, in particular, at greater sheet-processing speeds, and, preferably, in a cost-effective manner. In accordance with the invention, this object is achieved in that a deposit surface of the deposit tray is arranged, or can be arranged, at an angle that deviates from the horizontal.

26 Claims, 8 Drawing Sheets

DEVICE AND TRAY FOR DEPOSITING SHEETS

Figure 1:
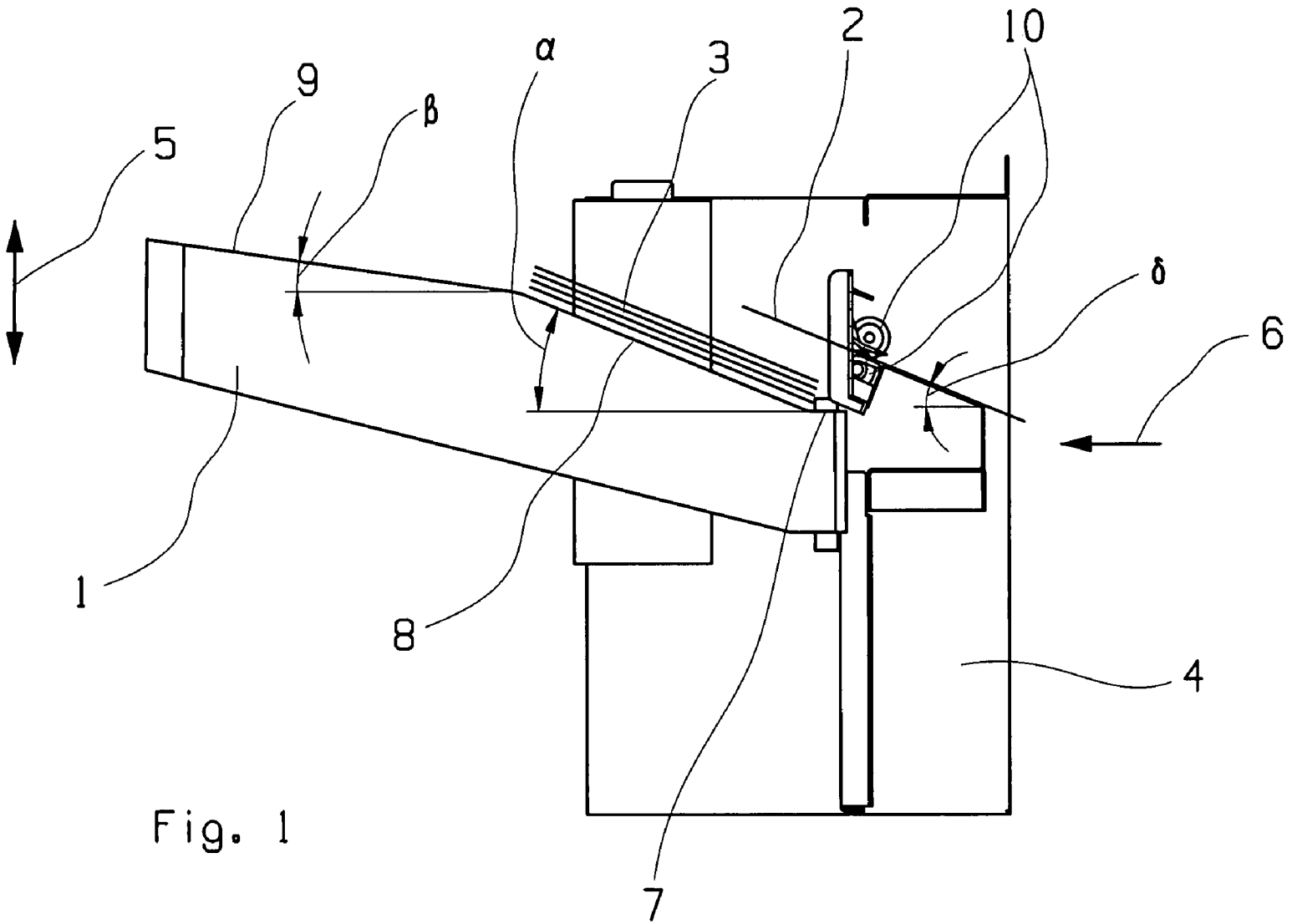

The invention relates to a device for depositing sheets in a machine that preferably processes sheets by graphic means, in particular for a printing machine, preferably for an electrophotographically operating machine, comprising at least one deposit tray for depositing and preferably also for stacking processed sheets.

Furthermore, the invention relates to a deposit tray for a device of the aforementioned type.

Document DE 101 54 743 A1 discloses, among other things, a simple design of a support tray for a stack of sheets, which tray may optionally also be a component of a device of the aforementioned type and be specifically arranged on the delivery side of a printing machine.

Considering in particular electrophotographically operating printing machines, sheets of the most diverse kind are to be processed, for example, sheets having a different weight per unit area, different size, different surface finish and the like, specifically, because a particular advantage of electrophotgraphic printing is that printing may be personalized and customized. Therefore, printing jobs may also be carried out which include a great variety of different printing materials. However, at the same time, there is the demand for carrying out such printing jobs more rapidly and more cost-effectively than before.

Depending on the type of sheets, there may be difficulties regarding precise depositing and stacking of the sheets, which may have an unfavorable effect on the subsequent handling of the stack of sheets, for example, if these sheets will have to be bound, stitched or fed to a so-called finishing step in another way.

Therefore, the object of the invention is to provide a device or a deposit tray of the aforementioned type, which permits a controlled depositing and stacking of sheets, in particular, at greater sheet-processing speeds, and, preferably, in a cost-effective manner.

In accordance with the invention, this object is achieved in that a deposit surface of the deposit tray is arranged, or can be arranged, at an angle that deviates from the horizontal.

An inventive setting angle can advantageously be adapted, in particular, to the sheet quality and the sheet transport speed, in which case this angle can be adjusted about an axis in longitudinal and/or transverse direction with respect to the sheet transport direction.

A modification of the invention provides that the deposit surface is aligned at an oblique upward angle relative to the horizontal plane.

As a result of this, arriving sheets can be intercepted and caught, and stacked in proper alignment. In addition, if necessary or desired, the transport speed of the sheets may be slightly reduced before said sheets are deposited. Preferably, the angle ($\alpha$) is approximately 15° to approximately 30°, preferably approximately 22°. Even a variability of the angle on demand would be conceivable.

A modification of the invention provides that the deposit surface is configured at an angle having an angle apex line extending transversely with respect to the sheet transport direction. By using such an angle, it is possible to allow, in particular, large sheet formats. Depositing and stacking in accordance with the invention are particularly advantageous and safe, in particular, also when large sheet formats are concerned, specifically also in the case of relatively low weights per unit area and/or higher transport speeds, namely when, as provided by another modification, the deposit surface initially rises relatively steeply at a first angle ($\alpha$) in sheet transport direction in a first section and is oriented at a second angle ($\beta$) at a relatively flatter angle with respect to the horizontal plane in a second section. Also, this type of deposit tray can be produced in a cost-effective manner, for example, of plastic material.

In this case, the angle ($\beta$) preferably is approximately 4° to approximately 12°, preferably approximately 8°.

Alternatively or additionally, a further modification of the invention provides that the deposit surface is inclined or rotated laterally at an angle relative to a horizontal sheet transport path. In so doing, angle ($\gamma$) may preferably be approximately 5° to approximately 15°, preferably approximately 9°.

As a result of this inventive arrangement and configuration, advantageously also in the case of larger sheet formats, lower weights per unit area and/or high transport speeds, a defined and cleanly aligned stacking of sheets is ensured in a simple and cost-effective manner, and any subsequent handling is facilitated. This is true, in particular, when, as preferably provided, the deposit surface is largely, or at least in sections, provided with a frame in a compartment-like manner, which said frame is essentially configured at a right angle on its side facing the arriving sheets, and when the front side of the thusly created compartment facing the arriving sheets is docked to the machine—with respect to a vertical surface oriented in a direction transverse to the sheet transport direction, when viewed from the top, at approximately the same angle ($\gamma$) of approximately 5° to approximately 15°, preferably approximately 9°—so that said compartment can be pivoted about a perpendicular axis.

This framing aids the stacking and aligning of the sheets. As a result of the pivotable arrangement, it becomes possible that a right corner angle can be accommodated in this frame, despite the lateral tilt of the deposit surface, and that no oblique-angled deposit surface is created.

Still, as a precaution, the frame may have open sections in the corner areas and/or near-corner areas as free space for the corners of the sheets. Likewise, the frame could be open laterally in the regions of the angle apex line to create free space for the sheets. Thus, a drawer-like closed frame is not necessary, but the frame can be reduced to guiding and abutment surfaces for the sheets.

A further modification of the invention provides that, facing the arriving sheets, an approximately horizontal section is provided as the first and deepest section of the deposit surface. This is particularly useful for sheets having low weight per unit area, in order to hold these sheets firmly on the deposit tray, and to prevent these sheets from slipping into or getting stuck in the gap between the deposit tray and the remainder of the machine. In so doing, the horizontal section may extend approximately 10 millimeters to 30 millimeters, preferably approximately 20 millimeters, viewed in transport direction, this being sufficient for the mentioned purposes.

The aforementioned openings in the frame creating free spaces for the sheets, when they are moving onto the deposit surface, may preferably be longer, preferably approximately 50 percent longer, than the said horizontal section, viewed in sheet transport direction.

In accordance with a modification of the inventive device, the stacking of sheets—including a stacking height control—is facilitated in that the deposit tray is arranged such that it can be raised and lowered. To achieve this, the deposit tray or the stack formed on the deposit tray may be guided along a guide, in which case, to achieve guiding, the deposit tray and/or the guide may comprise tooth or gear means. Preferably, the guide has sliding surfaces having a relatively low coefficient of friction for the sheets and relative to the sheets, in order to ensure an unimpaired and proper stacking and subsequent descending of the sheets. For example, the deposit tray may be raised or lowered at a rate of 10 millimeters per second. In so doing, the teeth may create a form-closed guide, and may also leave open gaps through which an air exchange is possible in order to avoid air cushions, which could impair the movement of the deposit tray due to said tray's air resistance.

A further modification of the invention provides that, upstream of the deposit tray, viewed in sheet transport direction, at least one transport element is provided which releases the respective sheet oriented such that it points diagonally upward with respect to the horizontal plane and transfers said sheet onto the deposit tray. Therefore, advantageously, the sheet is released already before or during the transfer to the deposit tray at an approximately appropriate setting angle, which the sheet will assume in the first section of the deposit tray. Preferably, this setting angle or angle of orientation ($\delta$) is dimensioned smaller or equal to the oblique angle ($\alpha$) of the deposit tray itself. Preferably, the angle of orientation ($\delta$) is preferably approximately 10° to 20°, preferably approximately 15°.

A preferred embodiment of the inventive device provides that a vertical dropping distance, or a step, down to the deposit surface is provided for the arriving sheets. This ensures clean stacking; thus, each subsequent sheet is completely dropped on the existing stack, without having said sheet rub across the stack and, in so doing, potentially shift the uppermost sheet on the stack of sheets. Thus, the dropping distance, or the step, may preferably exhibit a perpendicularly measured level difference of approximately 30 millimeters to approximately 40 millimeters, preferably approximately 35 millimeters. In order to control or adjust the level difference, for example, using a tolerance of approximately 5 millimeters, an additional sensor device may be provided. The height of the stack itself may be 200 millimeters, for example.

Additional independent protection is requested for a deposit sheet of the aforementioned type, which, in accordance with the invention, is characterized in that a deposit surface of the deposit tray is arranged, or can be arranged, at least at an angle deviating from the horizontal.

Preferred modifications of the deposit tray are disclosed by the Claims. Respective advantages of the inventive features have already been roughly summarized in conjunction with the inventive device. Overall, this is intended to avoid repetitions.

Preferably, the deposit surface of the deposit tray is aligned at an oblique upward angle relative to the horizontal plane, in which case, preferably, the deposit surface is configured at an angle having an angle apex line extending in a direction transverse to the sheet transport direction, in that, preferably, the deposit surface initially rises relatively steeply at a first angle ($\alpha$) in sheet transport direction in a first section and is oriented at a second angle ($\beta$) at a relatively flatter angle with respect to the horizontal plane in a second section.

Also or alternatively, the deposit surface may be inclined or rotated laterally at an angle ($\gamma$) with respect to a horizontal sheet transport path.

A preferred embodiment provides that the deposit surface is largely, or at least in sections, provided with a frame in a compartment-like manner, which frame is essentially configured at a right angle on its side facing the arriving sheets, and that the front side of the thusly created compartment facing the arriving sheets is docked to the machine in a pivoted manner—with respect to a vertical surface oriented in a direction transverse to the sheet transport direction when viewed from the top—at approximately the same angle ($\gamma$).

Especially considering thinner sheets and their more secure position on the deposit tray, it is preferably provided that, facing the arriving sheets, an approximately horizontal section is available as the first and deepest section of the deposit surface.

In addition, to provide a controlled formation of a stack of sheets, the deposit tray is arranged, or can be arranged, such that it can be raised or lowered, and, in so doing, preferably, can be arranged on a guide, in which case in particular the deposit tray may be provided with teeth.

With regard to the formation of a stack, in particular in a commercial printing machine, where a stack is optionally to be transferred for continued processing by binding, stapling, folding or the like, it should be possible to achieve a stack edge alignment whereby the lateral position of the stacked sheets varies only by a maximum of approximately +/−15 millimeters. In particular with long sheets, which must be transported out more rapidly, even a very minimal angular deviation can lead to much larger deviations. Some large deviations are also caused by the fact that the sheets are transported against an abutment edge in order to align the lead edge of the sheets, in which case rebounding causes even more of a lateral deflection.

A further object of the invention is to improve a device of the aforementioned type in order to ensure an adequate and reliable alignment of the sheets, in particular, also in view of high depositing rates and/or high stacks and/or long sheet formats.

In accordance with the invention, this object is achieved in that the guide surfaces are suspended above the stacking surface.

As a result of this, the inventive device advantageously provides that each sheet to be deposited and the substantial part of a stack are guided reliably and accurately, irrespective of the height of this stack, the speed with which the sheet is deposited or the length of the sheet.

In particular, the inventive device may comprise a stacking tray, especially the aforementioned tray, which can be lowered and perfectly interacts with the suspended guide surfaces.

A device of the aforementioned type is known from U.S. Pat. No. 6,505,830 B2. With this device, guide surfaces extend through a stacking tray in order to laterally guide and align a stack of sheets. To accommodate different sheet widths, guide surfaces of this type are provided at various distances, allowing guide surfaces that are covered by a wider sheet and thus not utilized to be lowered. But, this known device is rather complex regarding its design and not sturdy enough for commercially operated printing machines. In addition, only a relatively low stack can be formed in this manner on the stacking tray, which is stationary in this case. Further, considering relatively high printing and ejection rates, problems may also arise regarding the productivity level of a printing machine, as well as regarding long sheet formats.

It has been found that it is sufficient, in accordance with the invention, to provide the guide surfaces for guiding only an upper region of the stack. Underneath that, a stacking tray can be lowered almost without restriction in order to build an increasingly taller stack. In contrast, prior art only provided for guiding the foot area of the stack, and too large a stack could then slip off-center or even tip over.

Furthermore, an additional advantage of the inventive device is that, underneath the guide surfaces, a part of the stack remains visible to an operator, who can thus monitor it. Even a removal of the finished stack is made easier by the inventive device.

A preferred embodiment of the inventive device provides that the guide surfaces are pivotably suspended so that they can follow the lowerable stacking tray for a certain distance in a downward moving direction; however, it has been found that approximately 40 millimeters are sufficient.

With the stacking tray raised, the guide surfaces may rest on the stacking tray; for this purpose, the guide surfaces may have bearing rollers in the region of their lower edges. As the stacking tray is being lowered and the stack is growing, the guide surfaces preferably pivot farther down, in which case the bearing rollers roll off the stacking tray until—as the stacking tray is being lowered even further—they finally come off the stacking tray.

Another modification of the invention provides that the guide surfaces can be pivoted upward. In their upward pivoted position, the guide surfaces can preferably be fixed or locked in place outside their working position. Consequently, in particular, a finished stack can be removed easily from the stacking surface.

Another modification of the invention provides that the guide surfaces can be unhinged from their suspending means, that they can be unlocked from or with a pivoting axle, or that they can be unhinged. This is another feature that makes removal of the stack easier. Preferably, however, the unhinging feature specifically represents a safety feature in order to avoid injuries to an operator, in particular, to prevent their being pinched between the top side of the stack and the guide surface elements.

Preferably, the guide surfaces can be unhinged from their suspension in that the stacking tray, in particular the stack on the stacking tray, is raised.

Another modification of the invention, which, likewise, independently solves the posed problem, is characterized in that the guide surfaces are provided for guiding mainly or only a rear area of a sheet or of a stack.

Also, in this case, a part of the lower stack remains visible to the operator, and the stack can be removed more easily. Still, advantageously, a substantial area of the respective sheet and the stack are guided, i.e., the rear area. It has been found that specifically the rear area must be guided securely in order to hold the sheet and the stack in alignment and to prevent a lateral swerving or breaking out of a sheet. Even with an impingement of the sheet on a front stack edge, the rebound would mainly lead to a break-out in the rear area of the sheet. Consequently, a genuine "threading" of the sheet and its front area is not at all that important, but rather a lateral holding of the sheet still in its rear area. Therefore, in accordance with the invention, the front area of the sheet initially moves past the guide surfaces until, finally, its rear area remains between the guide surfaces. This results, in particular, even at high depositing rates, in a precise stack alignment and guiding of the respective sheet.

Another modification of the invention provides that the guide surfaces can be changed with respect to their distance from each other. Preferably, the guide surfaces are arranged in such a manner that they adjust themselves by opposing mirror-symmetrical movements symmetrically with respect to the central axis of the sheet or of the stack. As a result of this, the inventive device can be adapted to changed sheet widths, in which case the sheet is preferably automatically centered.

The guide surfaces may be adjusted by means of a motor.

Also, a device for the detection of the inside distance between the guide surfaces may be provided.

In combination with the two aforementioned inventive measures, it is possible to additionally advantageously provide a controlling means for the automatic adjustment of the distance between the guide surfaces, in case the detected width deviates from the expected sheet width.

The schematic drawings show an embodiment of the inventive device which could also result in additional inventive features without, however, restricting the scope of the invention thereto.

They show in

Figure 2:
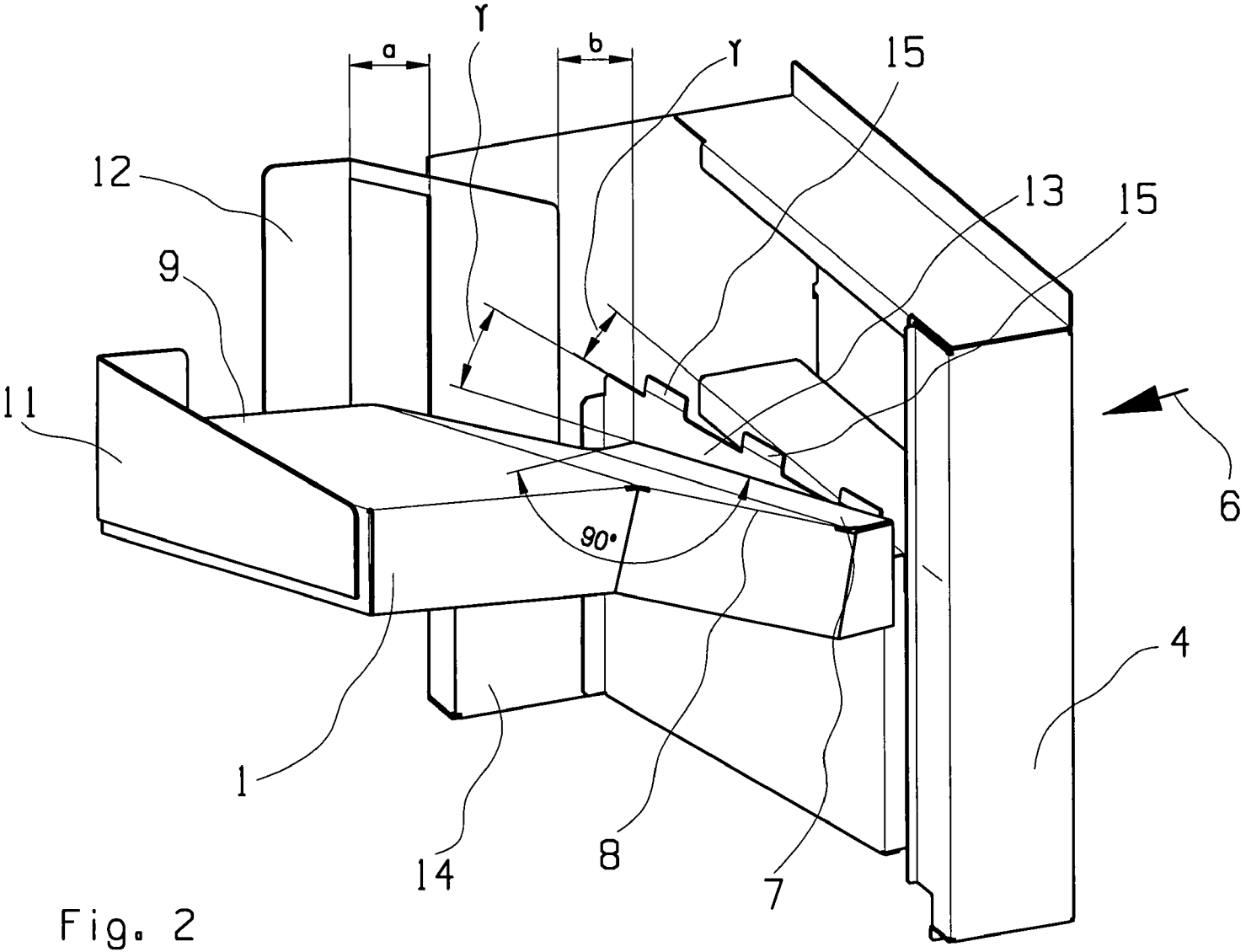
Figure 3:
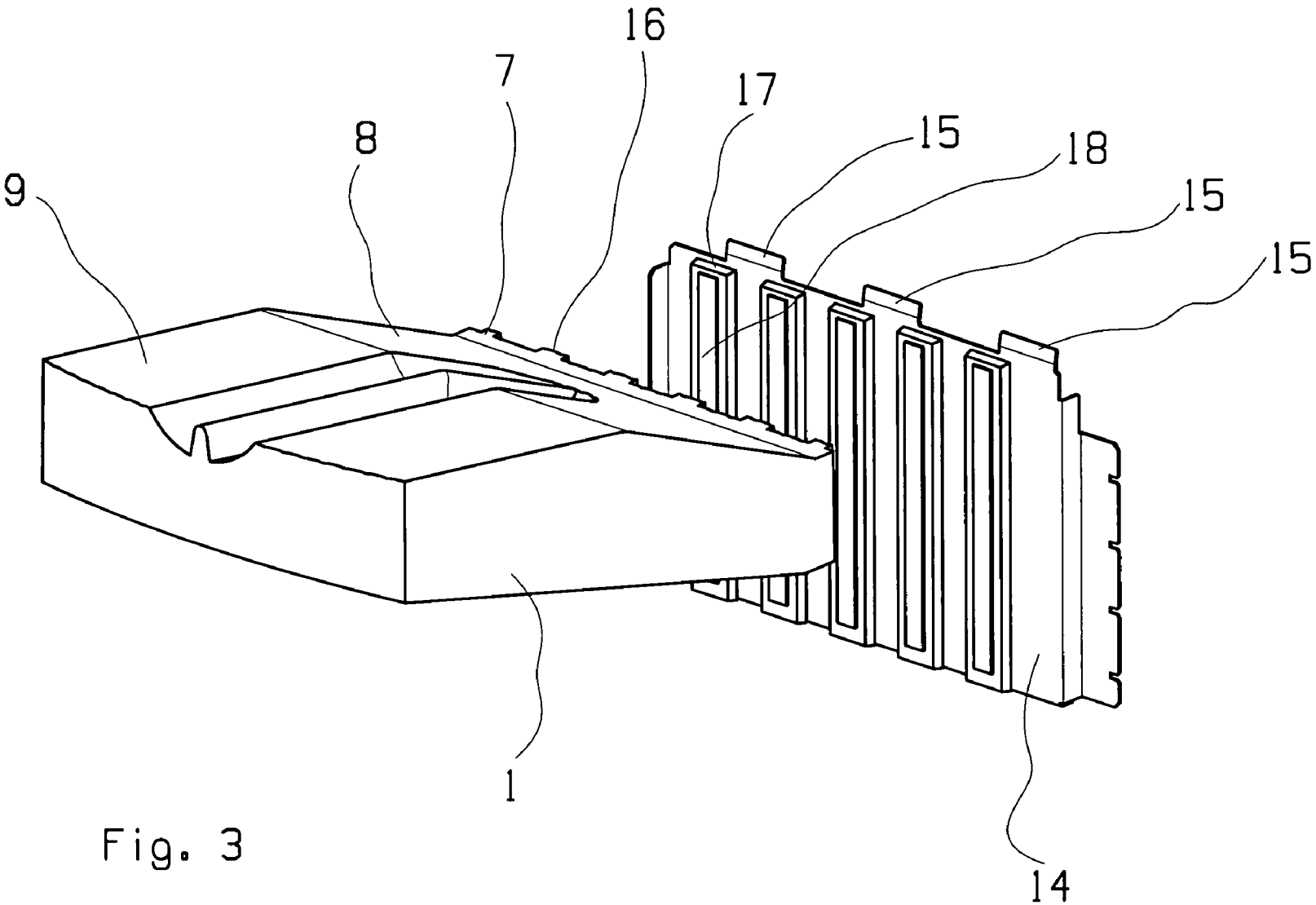
Figure 4:
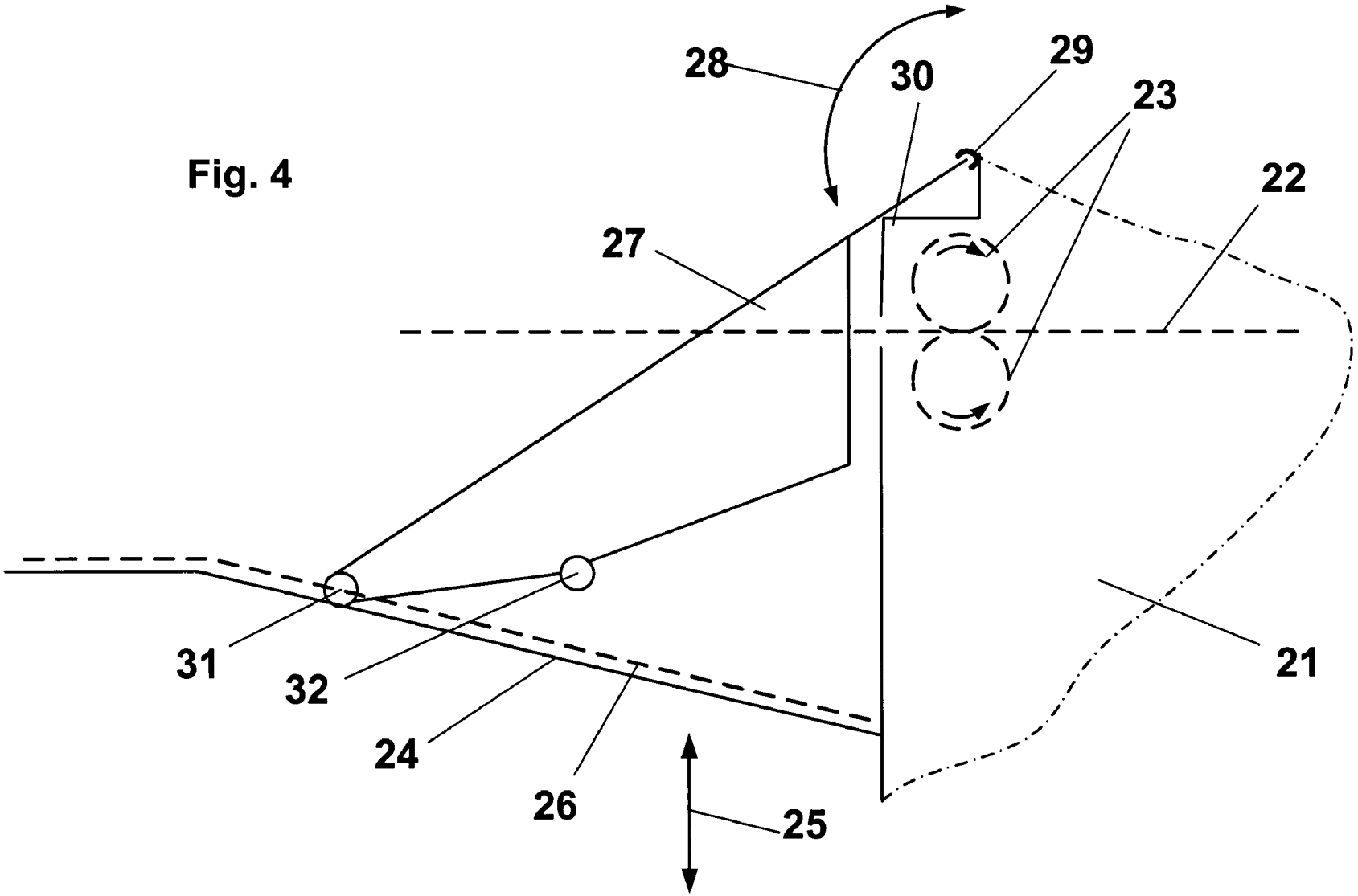
Figure 5:
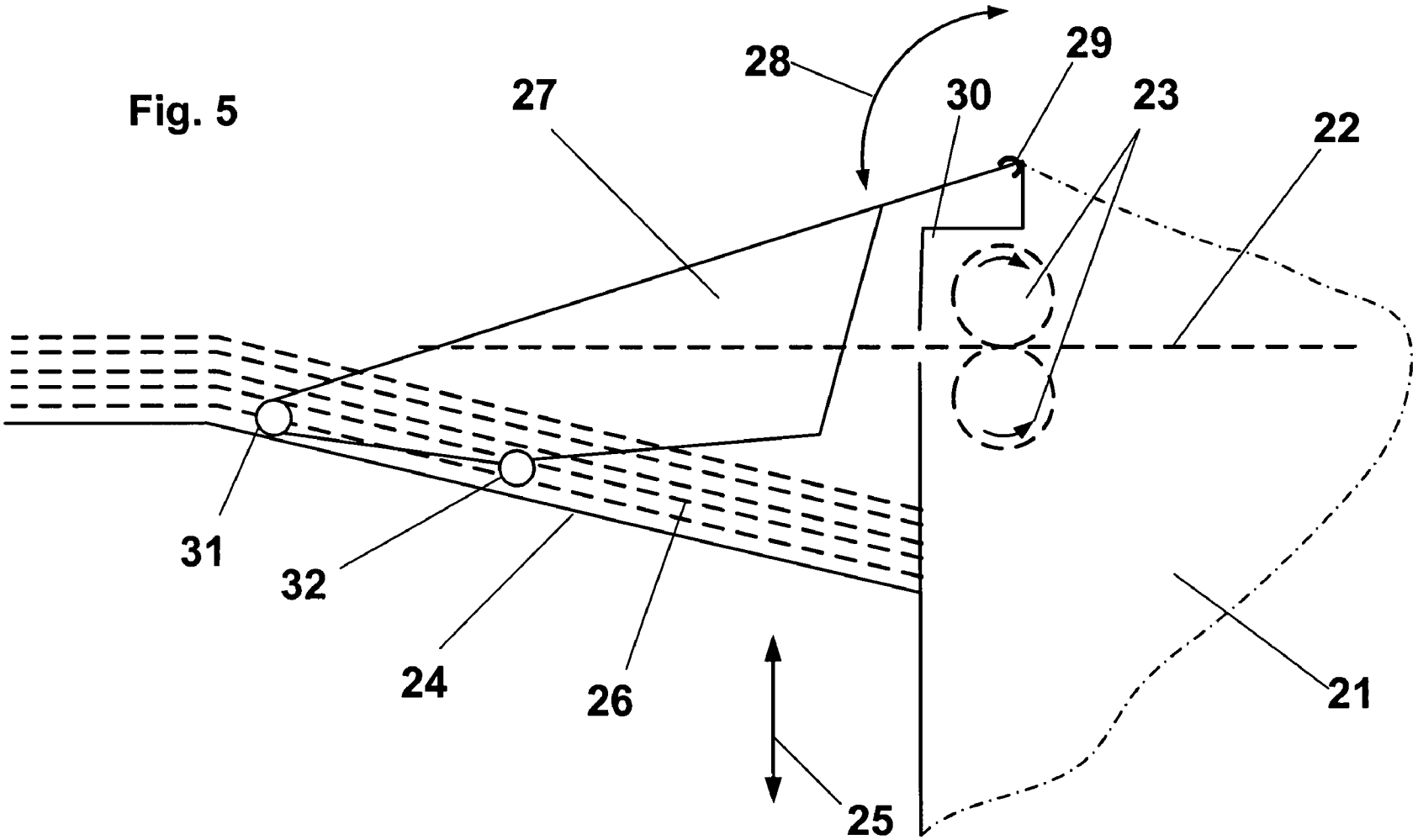
Figure 6:
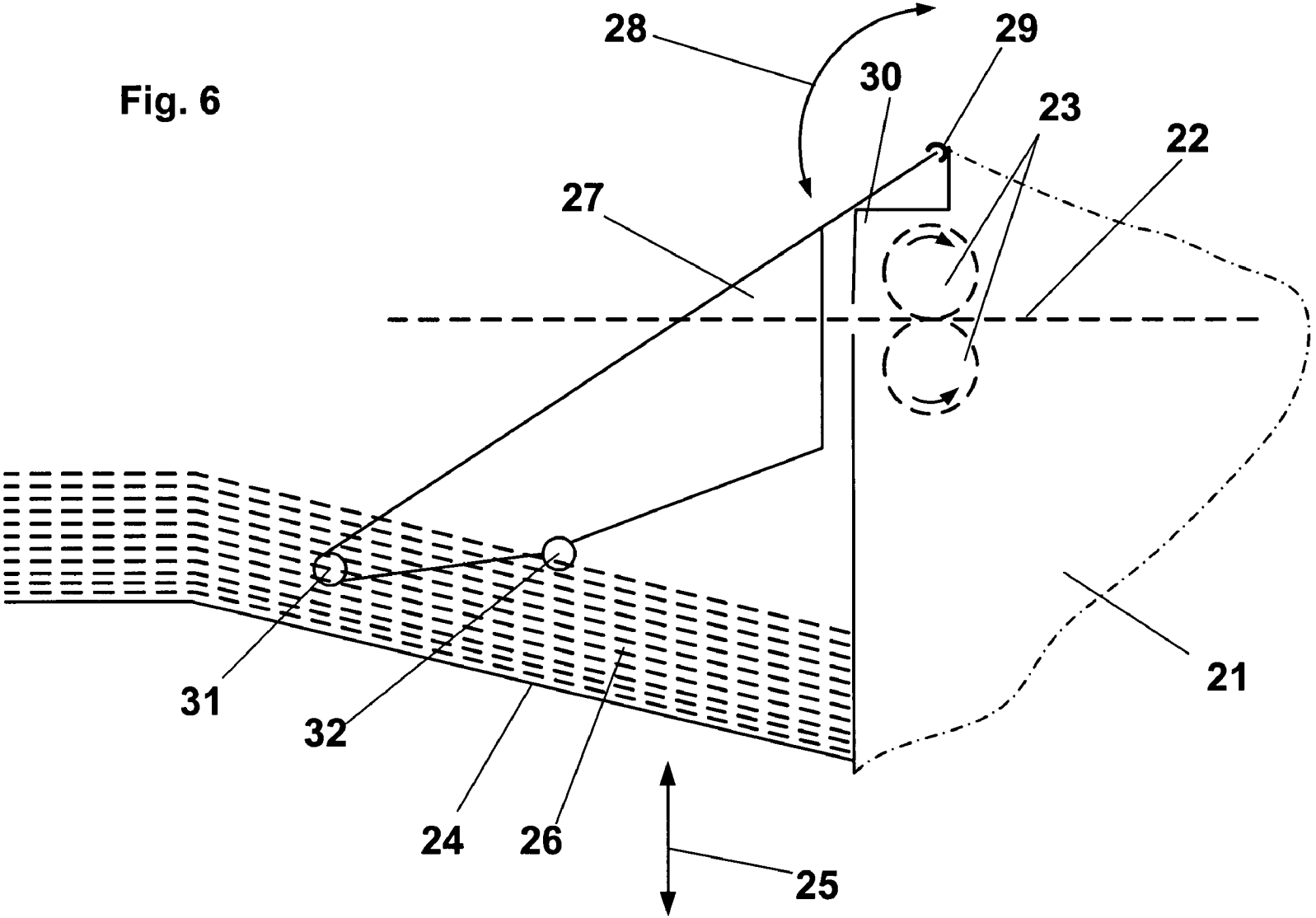
Figure 7:
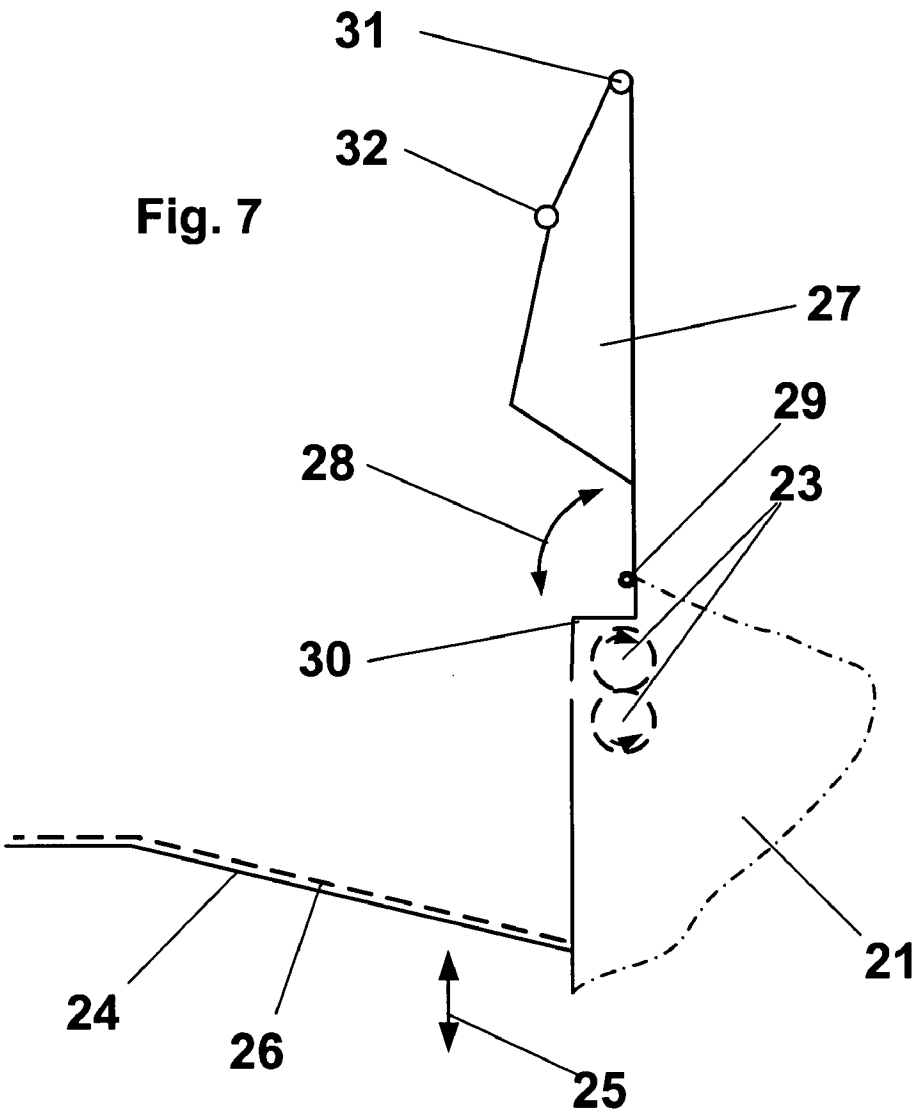

FIG. 1 a schematic sectional view of an inventive device;

FIG. 2 a schematic perspective view of the device as in FIG. 1;

FIG. 3 a schematic perspective view of a deposit tray for a device as in FIG. 2, in an exploded view, relative to a guide or stack wall;

FIG. 4 a side elevation of an inventive device comprising a stacking tray in a first position;

FIG. 5 the device as in FIG. 4, with the stacking tray in a more elevated position;

FIG. 6 the device as in FIG. 4, with the stacking tray in a more lowered position;

FIG. 7 the device as in FIG. 4 with the guide pivoted up; and

Figure 8:
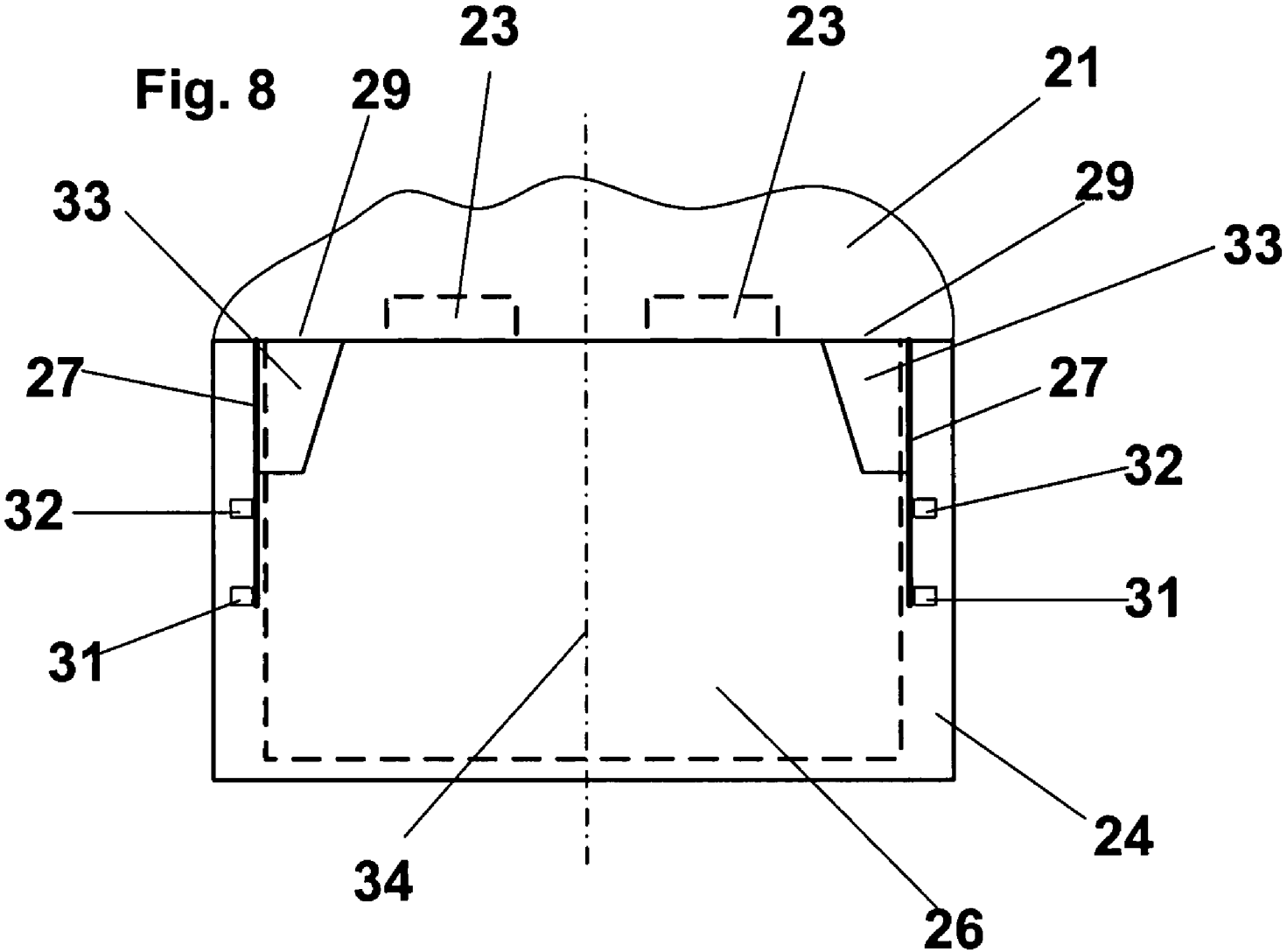

FIG. 8 the device as in FIG. 1, in plan view.

FIG. 1 shows a schematic sectional view of an inventive device. Specifically shown in FIG. 1 are a deposit tray 1 for a stack 3 formed by sheets 2, and a base frame 4 of the device. Deposit tray 1 can be raised and lowered on base frame 4 in the direction of double arrow 5.

Sheets 2 are fed to the device along a not specifically illustrated transport path in the direction of arrow 6. For example, the device can be mounted or docked to a printing machine on the delivery side.

The deposit surface of deposit tray 1 for stack 3 comprises, viewed in transport direction 6, essentially three successive zones or sections. Section 7 is a front and lowest section of the deposit surface which faces arriving sheets 2 and which extends approximately horizontally, and which extends, in transport direction 6 of sheets 2, for example, approximately 10 millimeters to 30 millimeters, preferably approximately 20 millimeters. This is followed by a first angled section 8 having a relatively steeply rising setting angle $\alpha$, which, for example may be approximately 15° to approximately 30°, preferably approximately 22°. This is followed by a relatively flatly rising second angled section 9 having a setting angle ($\beta$), which may be, for example, approximately 4° to approximately 12°, preferably approximately 8°.

Transport rollers 10, which may form the end of a transport path, already feed the respective sheet 2 to stack 3—which is essentially positioned on section 8 of the deposit surface of deposit tray 1—at a setting angle or angle of orientation $\delta$, which preferably is dimensioned smaller or equal to setting angle $\alpha$ of section 8 of deposit tray 1 itself and which, for example, maybe approximately 10° to 20°, preferably approximately 15°.

FIG. 2 shows the device of FIG. 1, again in a perspective view. The same component elements have the same reference numbers as in FIG. 1.

FIG. 1 illustrates, in particular, that the deposit surface consisting of sections 7, 8, 9 is limited by frame elements 11, 12, 13, so that the stack—which is not shown in FIG. 2—is deposited in a type of compartment. In addition, it can be seen that deposit tray 1 is pivoted out of the horizontal plane about an (imaginary) axis extending in transport direction 6 at an angle $\gamma$, which may be approximately 5° to approximately 15°, preferably approximately 9°. As a result of this, the deposited stack 2 slides into the corner formed by frame elements 12 and 13, said corner having an angle of 90°, and is aligned there. In order to obtain this right angle, despite the pivoting action about angle $\gamma$, deposit tray 11—when viewed from the top—is pivoted about an (imaginary) perpendicular axis with frame element 13 about the same angle γ, away from the (remaining) base frame 4. Said corner between frame elements 12, 13, however, has a free space for the corner of stack 2, said space extending along a distance b between said two frame elements. Also, frame element 12 itself has (in the region of the boundary or apex between sections 8, 9) a free space a. In so doing, free spaces a, b, for example, may be configured longer, preferably approximately 50 percent longer than the horizontal section 7 of the deposit surface, viewed in transport direction 6 of sheets 2.

Deposit tray 1 can be arranged in a not specifically illustrated manner on a lateral element 14 of base frame 4, so that it said deposit tray can be raised and lowered. During this movement, the abutment surface of stack 3 slides along frame element 13, which is configured as the stack wall. For the unimpaired transfer of sheets to deposit tray 1, frame element 13 has, in addition, on its upper end, tabs 15 which act as sliding ramps and are angled slightly toward transport direction. Here, the angle with respect to the stack wall may be approximately equal to angle γ.

FIG. 3 shows an exploded view of deposit tray 1 and frame element 13 configured as the stack wall.

This drawing shows that deposit tray 1 has, on its front side facing frame element 13, teeth 16, which act as abutments and spacers relative to frame element 13 in order to permit an air exchange through the gaps between teeth 16, which, however, can also mesh with raised ribs 17 on frame element 13 that support sliding strips 18 in order to improve the sliding motion of the stack abutment surface.

FIG. 4 shows a side elevation of an inventive device comprising a stacking tray in a first position.

The device is arranged on the stacker side of a printing machine body 21, of which only a small section is shown schematically. In the drawing of FIG. 4, a sheet 22 is indicated as it is transported by contradirectionally rotating stiffening rollers 23 in the direction of a stacking tray 24. The stacking tray 24 can be moved up and down in the direction of a double arrow 25. The stacking tray is brought to a level at which the processed sheet 22 must drop a certain distance to the level of the stacking tray 24, as soon as said sheet is released by the stiffening rollers 23. As the stack of sheets 26 grows on the stacking tray 24, the stacking tray 24 is continuously lowered correspondingly in order to maintain a constant distance between the level of the stiffening rollers 23 and the top side of the stack. The stacking tray 24 is angled and has an inclined section, so that the sheets deposited on the stacking tray 24 slide in the direction of the printing machine body 21 and come to a stop. An abutment edge for the sheets 2 could also be provided on the free end of the stacking tray 24, where the lead edge of the sheets comes into abutment first. A stacking tray 24, as shown by the drawing, is preferably used for printed test sheets. However, in conjunction with the invention, also differently configured stacking surfaces can be used, in particular, for depositing runs of printing sheets.

FIG. 4 shows a sheet 26 deposited on the stacking tray 24, i.e., for the sake of clarity, only one sheet 26. Corresponding to the already relatively far lowered position of the stacking tray 24, normally an already larger stack of sheets 26 would have formed on the stacking tray 24. The sheet 26 is guided and aligned on both sides by guide surfaces 27, only one of said guide surfaces 27 being shown, of course, in side elevation. The guide surfaces 27 are pivotable along a double arrow 28 about a hinge axle 29 and are suspended therefrom.

FIG. 4 shows the stacking tray 24 just in a position, in which the guide surfaces 27 still rest on the stacking tray 24 but are already touching down on an edge 30 of the printing machine body 21 at the end of their pivoting movement. The guide surfaces 27 contact the stacking tray 24 in different positions by means of different bearing rollers 31, 32. In FIG. 4, the bearing rollers 31 of the guide surfaces 27 rest on the stacking tray 24.

In the remaining figures, the same reference numbers are used as in FIG. 4.

FIG. 5 shows the device as in FIG. 4, with the stacking tray 4 in an even more elevated position than in FIG. 4.

In this position, the guide surfaces 27 do not yet noticeably rest on the edge 30. Almost all the bearing rollers 31 and 32 of the guide surfaces 27 contact the stacking tray 24. In an even more elevated position, the guide surfaces 27 would contact the stacking tray 24 only with the bearing rollers 32. During the movement of the stacking tray 24 in the direction of the double arrow 25 and the simultaneous pivoting movement of the guide surfaces 27 in the direction of the double arrow 8, the respectively contacting bearing rollers 31, 32 roll off the stacking tray 24.

In FIG. 6, a small stack of sheets 26 is symbolically indicated.

FIG. 6 shows the device as in FIG. 4, depicting a slightly more lowered position of the stacking tray 24 than is shown in FIG. 4. The stack of sheets 26 is symbolically already slightly larger than in FIG. 5.

In this position, the guide surfaces 27 rest already noticeably on the edge 30. None of the bearing rollers 31 and 32 of the contact surfaces 27 are in contact with the stacking tray 24 any longer.

FIG. 7 shows the device as in FIG. 4, on a reduced scale. In this illustration, the guide surfaces 27 have been (manually) pivoted all the way up. In this position, a finished stack can be particularly easily removed from the stacking tray 24. In this elevated position, the guide surfaces 27 can preferably be fixed or locked in place. This may be achieved, for example, in a relatively simple way with spring-biased ball plungers, which, for example, come into engagement with cutouts or holes of the guide surfaces, which, however, can also be easily disengaged against a certain resistance.

The guide surfaces 27 can preferably be unhinged from their suspension on the hinge axle 29. This could be done in the pivoted open position of FIG. 7, but also in another position.

In particular, this could also be useful regarding the work safety of the device.

If, for example, a stacking tray 24 fully loaded with a high stack of sheets 26 is moved up accidentally, the guide surfaces 27 too can be raised or ultimately even completely disengaged automatically. As a result of this, for example, an operator's hands cannot become pinched between the stack surface and the guide surfaces 27.

FIG. 8 shows a reduced scale plan view of the device as in FIG. 4.

In this illustration, additional corner reinforcements 33 of the guide surfaces 27 can be recognized. These corner reinforcements 33 are also useful for extended hinging on the hinge axle 29.

The guide surfaces 27 are adjustable with respect to their distance from each other, preferably by means of a motor, in order to accommodate different widths of sheets 26. The adjustment is mirror-symmetrical with respect to the longitudinal axis 34 of the stacking tray 24. The distance between the guide surfaces 27, or their respective positions, could be specifically optically detected.

FIGS. 4 through 23 and 25 show that the guide surfaces 27 guide the stack of sheets 26, in particular, in a rear area close to the printing machine body 21, this, of course, being relative with respect to the respective length of the sheet 26. Short formats will be guided along their entire length.

FIGS. 4 through 23 also show that the guide surfaces 27 guide the stack of sheets 26 mainly in an upper region, this, of course, also being relative with respect to the individual stack height. Low stacks are guided along their entire height.

Also, FIGS. 4 through 23 show in particular that a sheet 21 is already guided by the guide surfaces 27 when it is ejected from the stiffening rollers 23, i.e., first said sheet's front area and then continuing toward the back. In the case of high depositing rates, the sheet 21 drops or "flies" in a sort of throw trajectory out of the stiffening rollers 23 and then drops onto the stacked sheets 26. As a result of the guide surfaces 27 arranged in accordance with the invention, the sheet 21 is advantageously guided, deflected and aligned during its entire "flight".

The invention claimed is:

1. Device for depositing sheets in an electrophotographical printer, comprising at least one deposit tray for depositing and also for stacking processed sheets wherein a deposit surface of the deposit tray is arranged, at an angle that deviates from the horizontal so the deposit surface is inclined relative to a horizontal sheet transport path and transverse to a sheet transport direction wherein the deposit surface is provided with a frame and having at least two sections, a first section at a horizontal plane in transport direction and a second section facing a arriving sheet at an angle wherein said first section is essentially transverse to the sheet transport direction.

2. Device of claim 1, the angle (γ) between 5° and 15°.

3. Device of claim 1, the angle (γ) is approximately 9°.

4. Device as in claim 1 wherein in transport direction, the deposit surface is aligned at an oblique upward angle relative to the horizontal plane.

5. Device as in claim 1, wherein the deposit surface is configured at an angle having an angle apex line extending transversely with respect to the sheet transport.

6. Device as in claim 1, wherein the deposit surface initially rises relatively steeply at a first angle (α) in the sheet transport direction in the first section and is oriented at a second angle (β) at a relatively flatter angle with respect to the horizontal plane in the second section.

7. Device as in claim 1 wherein the frame may have open sections in the corner areas and/or near-corner areas as free space for the corners of the sheets.

8. Device as in claim 1 wherein the frame is open laterally in the areas of an angle apex line extending transversely with respect to the sheet transport direction to create free space for the sheets.

9. Device as in claim 1 wherein facing the arriving sheets, an approximately horizontal section is provided as the first and deepest section of the deposit surface.

10. Device as in claim 1 wherein the deposit tray is arranged such that it can be raised and lowered.

11. Device as in claim 10, wherein the deposit tray is guided along a guide.

12. Device as in claim 11, wherein as guides, teeth are provided on the deposit tray.

13. Device as in claim 1 further comprising upstream of the deposit tray, viewed in sheet transport direction, at least one transport element is provided which releases the respective sheet oriented such that it points diagonally upward with respect to the horizontal plane and transfers said sheet onto the deposit tray.

14. Device as in claim 1 further comprising a vertical dropping distance, as a step down to the deposit surface for the arriving sheets.

15. Device as in claim 14, wherein the dropping distance, is perpendicularly measured level difference between 30 millimeters and 40 millimeters.

16. Device as in claim 15, further comprising a sensor to sense the level difference so that the level difference can be controlled or adjusted.

17. Device of claim 14, wherein the dropping distance is measured to be 35 millimeters.

18. Device of claim 1, further comprising a third section separate from the first that is positioned in a horizontal plane and in the transport direction.

19. Deposit tray for a device further comprising a deposit surface of the deposit tray is arranged, at least at an angle that deviates from the horizontal so the deposit surface is inclined at an angle relative to a horizontal sheet transport path wherein the deposit surface is provided with a frame having at least two sections; a first section at a horizontal place in a transport direction and a second section facing arriving sheet at an angle of wherein said first section is essentially transverse to the sheet transport at an angle (γ) between 5° to 15.

20. Device of claim 19, the angle (γ) between 8° and 10°, inclusive.

21. Claim 19, the angle (γ) is 15°.

22. Deposit tray as in claim 19 wherein the frame has open sections in the corner areas as free space for the corners of the sheets.

23. Deposit tray as in claim 22 wherein the frame is open laterally in the regions of an angle apex line extending transversely with respect to the sheet transport direction to create free space for the sheets.

24. Device as in claim 19 wherein in transport direction, the deposit surface is aligned at an oblique upward angle relative to the horizontal plane.

25. Device as in claim 19 wherein the deposit surface is configured at an angle having an angle apex line extending transversely with respect to the sheet transport direction.

26. Device as in claim 25 wherein the deposit surface initially rises relatively steeply at a first angle (α) in sheet transport direction in the first section and is oriented at a second angle (β) at a relatively flatter angle with respect to the horizontal plane in the second section.

* * * * *